US005400764A

United States Patent [19]

Spolar et al.

[11] Patent Number: 5,400,764

[45] Date of Patent: Mar. 28, 1995

[54] MOUNTING BRACKET AND ASSEMBLY FOR ARCHERY BOW-SIGHT

[76] Inventors: Michael Spolar, R.D. #3, Box 303C; Gregory Spolar, R.D. #3, Box 303B, both of Montrose, Pa. 18801

[21] Appl. No.: 8,032

[22] Filed: Jan. 25, 1993

[51] Int. Cl.[6] ..... F41B 5/00

[52] U.S. Cl. ..... 124/88; 124/87

[58] Field of Search ..... 124/86, 87, 88; 33/265; 403/381, 380, 383, 109, 110

[56] References Cited

U.S. PATENT DOCUMENTS

| | | | |
|---|---|---|---|
| 3,574,944 | 4/1971 | Reynolds | 33/265 |
| 4,553,338 | 11/1985 | LeBeau | 124/87 |
| 4,585,247 | 4/1986 | Takada | 403/381 |
| 4,625,421 | 12/1986 | Strauss | 33/265 |
| 4,995,372 | 2/1991 | Topel | 124/88 |
| 5,048,193 | 9/1991 | Hacquet | 33/265 |
| 5,050,576 | 9/1991 | Larson | 124/87 |
| 5,131,153 | 7/1992 | Seales | 124/87 |
| 5,175,937 | 1/1993 | Emerson, III | 124/88 |

FOREIGN PATENT DOCUMENTS

| | | | |
|---|---|---|---|
| 2420736 | 11/1979 | France | 124/87 |

*Primary Examiner*—Randolph A. Reese
*Assistant Examiner*—Anthony Knight
*Attorney, Agent, or Firm*—Salzman & Levy

[57] ABSTRACT

The present invention features an archery bow mounting bracket for receiving and engaging a support arm, which includes a mounting plate, a clamping plate and a mechanism for securing the clamping plate to the mounting plate. A bracket assembly is also provided, which includes a support arm and a mechanism for securing and leveling the support arm within the slot formed by the joining of the mounting and clamping plates. This assembly has particular application for use with an archery bow for the deployment and support of an archery sighting device. The mounting bracket is made to be secured to the archery bow, preferably at the side of the bow handle, for engaging and removably securing a rectilinear support arm member to which the sighting device may be directly or indirectly attached.

14 Claims, 4 Drawing Sheets

MOUNTING BRACKET AND ASSEMBLY FOR ARCHERY BOW-SIGHT

BACKGROUND OF THE INVENTION

The present invention relates to a mounting bracket for use with an archery bow to accommodate the attachment and/or support of a sighting device, and, more particularly, to a mounting bracket and support arm assembly for the deployment and securement of a sighting device used in conjunction with an archery bow.

Sighting devices, or bow-sights, are commonly used with archery bows in tournament shooting or bow hunting. They are generally attached to an archery bow to provide a guide to the archer for proper elevation of the bow in order to achieve an accurate sighting and targeting of an object over a predetermined range of distances.

Examples of the most recent bow-sights may be found in U.S. Pat. Nos. 4,757,614 and 5,072,716. The bow-sights illustrated therein are positioned forward of the bow and generally comprise a plurality of sighting pins that are arranged in such a fashion so as to permit their alignment with corresponding yardage distances from the bow. By calibrating the vertical position of a given pin on the bow-sight with a corresponding distance that the arrow is shot, an accurate trajectory for the arrow, as well as a hitting of the target, can be achieved when the pin is aligned with the target by the archer. Accordingly, any movement of the pin(s) will affect the distance that an arrow will travel, assuming the archer is properly aligning the respective pin with a given target.

The bow-sights in the aforestated patents are generally mounted to the bow structure by a combination of a mount and a support arm. There are usually a plurality of them, arranged in series, which permit movement of the bow-sight in different directions forward of the bow. Thus, forward lateral movement of the sight, relative to the bow, is accomplished by means of a singular mount fixed to the side of the bow structure. The mount is adapted to receive a first slidable support arm to permit movement of the bow-sight forward of the bow. Vertical or cross-lateral movement of the sight is generally accomplished by means of a second singular mount fixed to the end of the first slidable support arm and adapted to receive a second support arm to which the bow-sight is usually attached. These mount-and-support-arm combinations have generally proven to be troublesome, primarily because of the inadequate securement of the support arm on the mount plate or bracket.

More specifically, and as illustrated in the foregoing patents, the support mount is a one-piece construction that is rigidly fastened directly to the bow handle. A dovetail slot is contained within the mount to slidably receive a support arm having a corresponding dovetail cross-section. The support arm has a plurality of longitudinally-spaced apertures that are threaded to receive a screw for securing the arm within the dovetail slot of the mount. This design has proven to be inadequate for supporting a sighting device, because the screw is threaded only onto the support arm, not the mount. Securement of the support arm member within the dovetail slot is achieved by turning the end of the screw against the support arm.

Accuracy of the bow-sight, therefore, depends in large part not only on the calibration of sight marks, such as crosshair sights, telescopes or pins to a corresponding distance, but also on the efficacy of the bow-sight's securement to the bow. With regard to the latter feature, any movement of the bow-sight in a vertical, lateral or horizontal direction will cause the accuracy of the arrow's trajectory to be compromised. This can obviously mean the difference between the arrow's hitting or missing the target. Such a movement of the bow-sight (and the subsequent deviation of the sighting pin's calibration) is usually the result of a support arm becoming loosened from its dovetail mount. Typically, misalignment is caused by repetitious use, jostling of the bow during transport, and/or inadequate securement of the bow-sight to the bow. After a disconnection, the subsequent reattachment of the bow-sight to a respective support arm will not usually be adequate; such an act will usually afford neither a constant fixing of the support arms nor a constant, reproducible sighting.

The aforestated deficiencies and problems inherent to dovetail mounts and support arms may be overcome by the present invention. This invention will become more apparent to those skilled in the art based on the following summary and the description of the preferred embodiment.

SUMMARY OF THE INVENTION

In accordance with the present invention, there is provided a mounting bracket for receiving and engaging a rectilinear support arm member comprising a mounting plate, a clamping plate and means for securing the latter to the former.

The mounting plate comprises an open channel formed by two opposing side walls extending from a mounting base. The opposite side of the mounting base may be configured so as to be fixedly secured to an archery bow or to a second support arm member. The clamping plate comprises an open channel formed by two opposing side members extending from a top plate, each of said side members being configured to mate in the space between the side walls of the mounting plate.

When the clamping plate is secured to the mounting plate, a rectilinear slot is formed by the side members, top plate and mounting plate base. The cross-sectional shape of these elements dictates the cross-sectional shape of the slot. Thus, in accordance with the invention herein, the slot is adapted to receive a rectilinear support arm member having a substantially corresponding cross-sectional shape.

As an adjunct to the mounting bracket, a means is also provided for releasably securing the support arm member within the slot thereof. One arrangement provides for engaging the support arm within the slot in such a manner that when the clamping plate is fully secured to the mounting plate, a compressive action is exerted on the support arm, resulting in the prevention of any movement therein. Thus, the same means for securing the clamping plate to the mounting plate is used for securing the support arm. The advantage of this arrangement is that it permits infinite transverse adjustment of the support arm in a forward or rearward direction.

Another arrangement provides for slidably and snugly receiving the support arm member within the slot when the clamping plate is fully secured to the mounting plate. This arrangement utilizes at least one threaded aperture in the support arm, and preferably a plurality of threaded apertures longitudinally spaced for cooperatively engaging a set screw within an identically threaded aperture in the clamping plate for removably fixing the support arm in the slot of the mounting bracket. A distinct advantage is obtained for securing the support arm in this manner, since the set screw engages both the clamping plate and the support arm.

In accordance with the invention herein, the mounting bracket can be combined with an appropriate rectilinear support arm member to form an assembly for application and use with an archery bow for the deployment and support of an archery sighting device. Thus, the mounting plate of the bracket is configured so as to be secured to the archery bow (preferably at the side of the bow handle) for engaging and removably securing a rectilinear, level support arm member to which the sighting device may be directly or indirectly attached.

Indirect attachment of the sighting device includes affixing a second mounting bracket to the support arm member for engaging and removably securing a second support arm member. The sighting device may then be attached to the second support arm member in such a manner so as to provide for additional adjustment and leveling of the sighting device in a vertical or cross-lateral direction forward of and relative to the bow. Accordingly, a single or plurality of mounting bracket assemblies can be used in conjunction with each other for the deployment and adjustment of a sighting device on an archery bow.

BRIEF DESCRIPTION OF THE DRAWINGS

A complete understanding of the present invention may be obtained by reference to the following detailed description of a preferred embodiment taken in conjunction with the accompanying drawings, and in which.

DESCRIPTION OF THE PREFERRED EMBODIMENT

Figure 2:
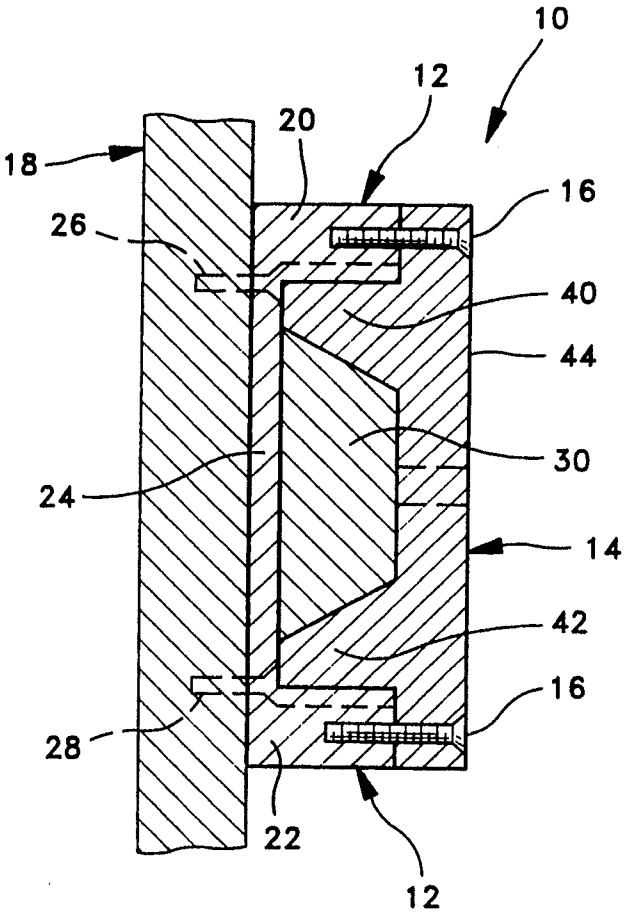
FIG. 2 is a side elevational view of the mounting bracket and support arm combination in assembled form, taken at line A—A as shown in FIG. 1.
Figure 1:
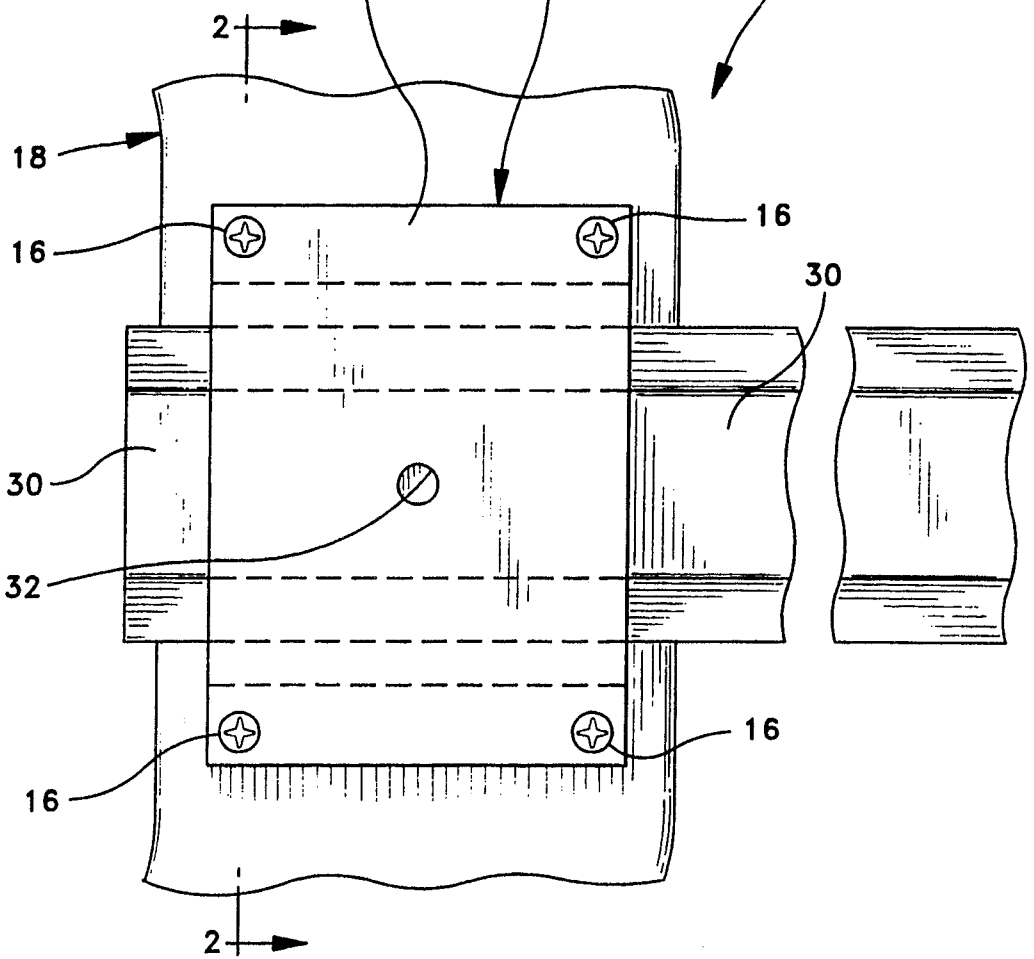
FIG. 1 is a front elevational view of a separated mounting bracket and support arm combination for securement to the side of an archery bow handle.

Referring to the drawings, FIGS. 1 and 2 illustrate a preferred embodiment of the invention's mounting bracket 10, which is designed to be attached to the side of an archery bow handle 18 for removably securing a support arm 30 therein. Bracket 10 comprises a rectangular mounting plate 12, a clamping plate 14 and a means for securing the clamping plate 14 to mounting plate 12, which, in the embodiment shown, is in the form of four screws 16 extending through the clamping plate into the mounting plate.

As best illustrated in FIG. 1, mounting plate 12 includes two opposing parallel side walls, 20 and 22, respectively, extending from a base 24. Side walls 20 and 22, and base 24 are of a one-piece construction that forms a rectilinear channel for slidably and snugly receiving clamping plate 14 therein. Mounting plate 12 is configured so as to be affixed to the side of an archery bow handle 18 by means of a pair of appropriately aligned openings 26 and 28 extending through base 24 and bow 18 for cooperatively engaging a pair of screws 46 and 48 (see FIG. 3).

Clamping plate 14 is also a one-piece construction and includes two opposing rectilinear side members 40 and 42 extending from a top plate 44. Side members 40 and 42 are recessed from the two respective outer edges of top plate 44 to permit mating of the side members between the side walls 20 and 22 of the mounting plate 12, and also to allow attachment of the top plate 44, hence clamping plate 14, to the side walls 20 and 22 of mounting plate 12 by means of screws 16.

As will be seen by viewing FIG. 1, when the mounting plate 12 and clamping plate 14 are joined together (but not fully secured) by screws 16, the interior walls of side members 40 and 42, top plate 44 and base 24 define a rectilinear slot which is adapted to slidably engage a rectilinear support arm 30 therein. Thus, the cross-sectional shape of the slot is such that it substantially conforms to the cross-section of support arm 30, with the provision that when clamping plate 14 is fully secured to mounting plate 12, a compressive force or clamping action is available to be exerted on support arm 30 by clamping plate 14 through the tightening of screws 16, which, in turn, results in the secure containment of support arm 30 therein.

The foregoing result is best achieved by making the cross-section of the slot slightly smaller than the cross-section of support arm 30. The best result is obtained when the open distance between base 24 and top plate 44 is slightly less than the thickness of support arm 30, when the mounting and clamping plates are fully secured to each other by screws 16 without the presence of support arm 30.

When it is desired to adjust support arm 30 within bracket 10, screws 16 are sufficiently untightened to allow support arm 30 to slide forward (or rearward) in the slot of bracket 10. In order to prevent the support arm 30 from being adjusted beyond a distance that would create instability of the mounting bracket assembly, an opening 32 is provided in top plate 44 to permit visual observation of the proximity of support arm 30 relative to its position in the slot of bracket 10.

It is important to note that side members 40 and 42 are provided for inclusion with top plate 44 in the design of clamping plate 14, in order to prevent any misalignment of support arm 30 (i.e., lateral or vertical movement within the slot), while screws 16 are being tightened to secure the clamping plate 14 over the support arm 30. The advantage of this critical element of the design is that, once the position of support arm 30 within bracket 12 is selected, the screw tightening process will not affect any lateral or vertical movement thereof because of its containment between rectilinear side members 20 and 22. This is especially important during a target-shooting competition when a bow-sight is utilized, directly or indirectly, at the forward end of support arm 30; an approximately 1/16-inch vertical movement of the forward end of the prior art dovetailed support arm can result in a 9-inch vertical deviation of the arrow from the target when shot from a distance of 40 yards.

Figure 3:
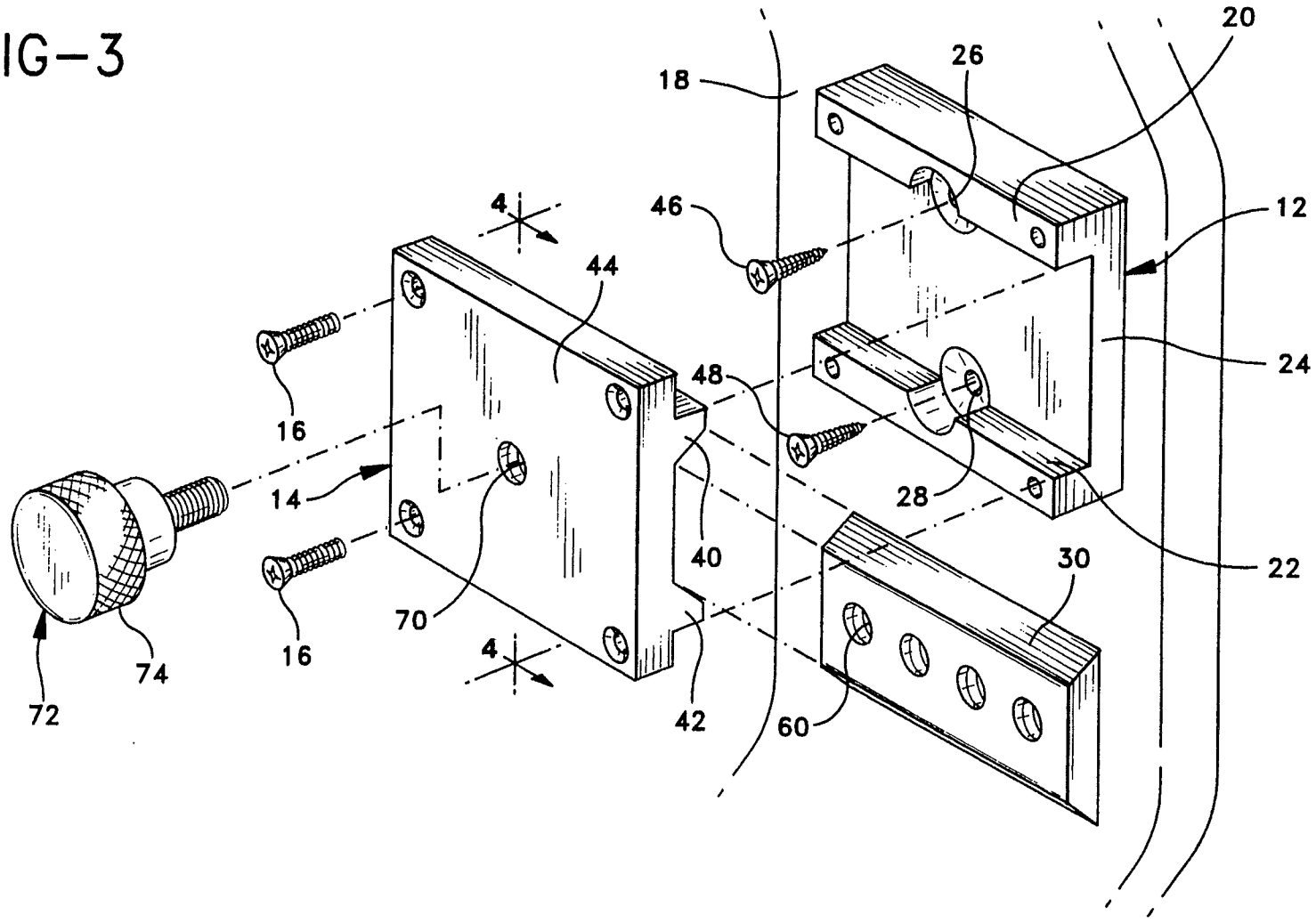
FIG. 3 is an exploded isometric view of an alternative configuration of a mounting bracket and support arm combination, affixed to the side of an archery bow handle, in accordance with the invention herein.
Figure 4:
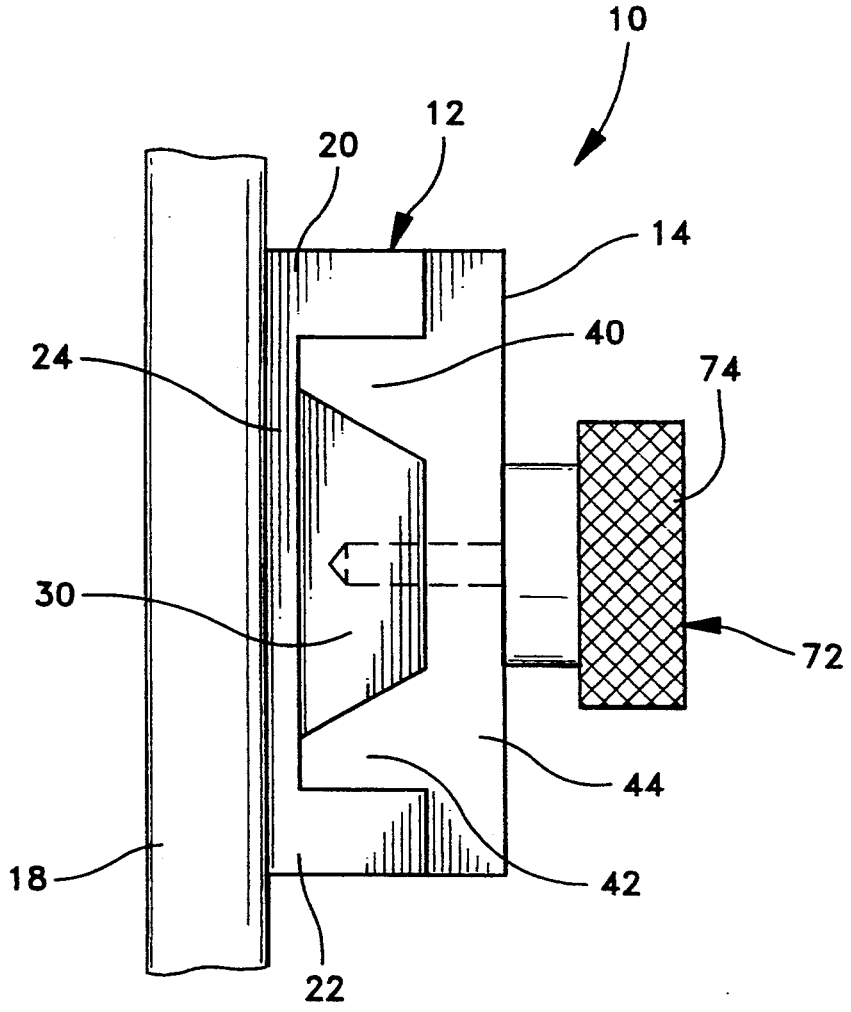
FIG. 4 is an assembled side elevational view of the mounting bracket and support arm combination, taken at line B—B as shown in FIG. 3.

The foregoing preferred embodiment utilizes the same means for securing clamping plate 14 to mounting plate 12 and for securing support arm 30 within bracket 10, viz., screws 16. Another embodiment for securing the support arm 30, according to the invention herein, is illustrated in FIGS. 3 and 4. Thus, the same bracket 10 is shown therein, with the exception that this embodiment provides for slidably and snugly receiving support arm 30 within the slot of the mounting bracket assembly when clamping plate 14 is fully secured to mounting plate 12 (FIG. 4).

In order to fully secure support arm 30 within the mounting bracket assembly, a plurality of longitudinally spaced threaded apertures 60 is provided within the support arm 30. Top plate 44 of clamping plate 14 are provided with an identical, threaded aperture 70 which is designed to receive adjustment screw 72 having a knurled knob 74, for cooperative, fixed engagement with one of the apertures 60 of support arm 30 (see FIG. 4). In this manner, adjustment screw 72 engages both the clamping plate 14 and the support arm 30 for the secure, rigid, and level containment of the support arm 30 to the archery bow 18.

Figure 5:
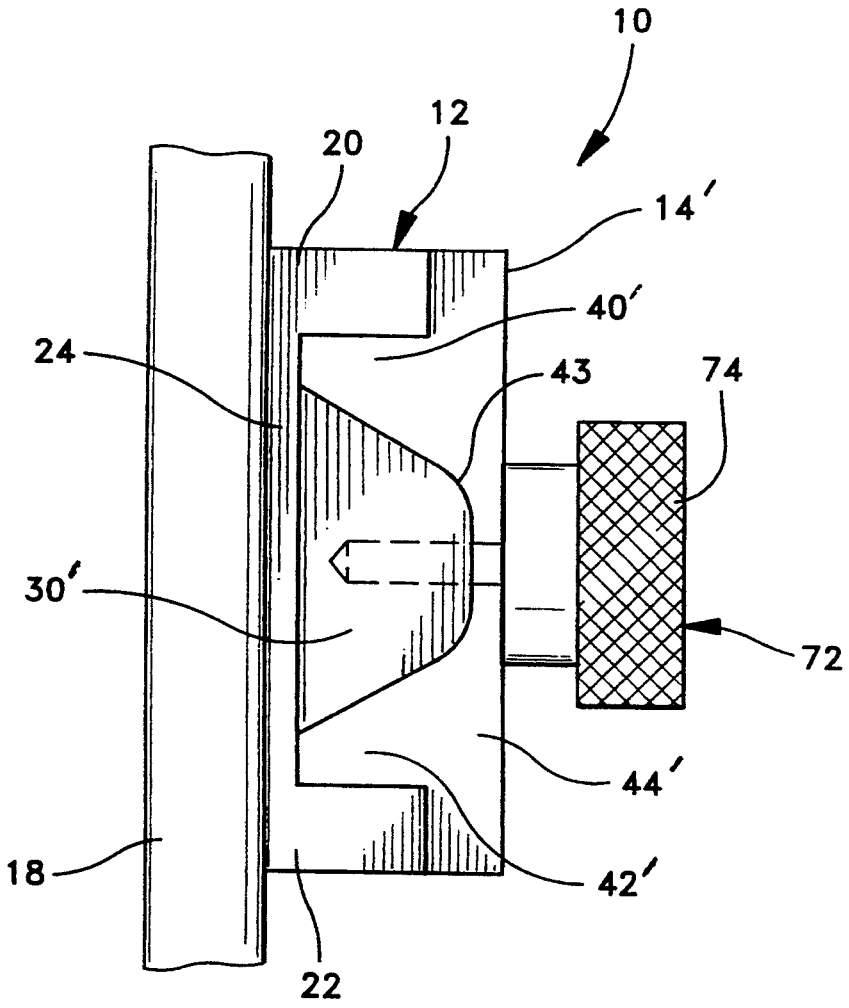
FIG. 5 is an assembled side elevational view of an alternate mounting bracket and support arm.

In the alternate embodiment of the present invention, depicted in FIG. 5, the top plate 44′ of clamping plate 14′ is configured to receive a support arm 30′ having a modified, non-rectilinear cross-section. Side members 40′ and 42′ are adapted, as shown, to receive support arm 30′ having a curved upper surface 43. It should be understood, however, that without departing from the scope of the present invention, any suitably-shaped support arm can be accommodated by the inventive device merely by changing the shape of the slot defined by side members 40 and 42 (FIG. 4).

The bracket and support arm, according to the invention herein, may be fabricated from any readily available rigid material capable of being machined for accommodating the assembly of the individual parts such as plexiglas, plastic, metal or mold injection compositions that are known to a person skilled in the art. Metal is the preferred material, particularly aluminum or stainless steel.

Since other modifications and changes varied to fit particular operating requirements and environments will be apparent to those skilled in the art, the invention is not considered limited to the specific embodiments chosen for purposes of disclosure, and covers all changes and modifications which do not constitute departures from the true spirit and scope of this invention.

What is claimed is:

1. An archery bow mounting bracket for releasably securing a rectilinear support arm comprising:

a mounting plate, comprising an open channel formed by two opposing side walls extending from a mounting base;

a clamping plate comprising an open channel formed by two opposing side members extending from a top plate, each of said side members being configured to mate between the side walls of said mounting plate; and means for securing said clamping plate to said mounting plate;

said side members, mounting base and top plate forming a rectilinear slot adapted to (i) slidably engage said support arm therein and (ii) secure said support arm within said slot when said clamping plate is secured to said mounting plate;

said means for securing said clamping plate to said mounting plate providing an infinitely adjustable support for said support arm.

2. The mounting bracket defined by claim 1 wherein said means for securing said clamping plate to said mounting plate comprises a plurality of screws cooperatively engaging said clamping and mounting plates in fixed relationship with respect to each other.

3. The mounting bracket defined by claim 1 wherein said top plate has an opening therein for visually determining the transverse position of said support arm in said slot.

4. An archery bow mounting bracket for releasably securing a support arm comprising:

a mounting plate, comprising an open channel formed by two opposing side walls extending from a mounting base;

a clamping plate comprising an open channel formed by two opposing side members extending from a top plate, each of said side members being configured to mate between the side walls of said mounting plate;

means for securing the clamping plate to said mounting plate, said side members and said mounting base and said top plate forming a slot adapted to slidably receive said support arm therein;

means for releasably securing said support arm within said slot of said mounting bracket; and said means for securing said clamping plate to said mounting plate being separate from said means for releasably securing said support arm.

5. The mounting bracket defined by claim 4 wherein said means for securing said clamping plate to said mounting plate comprises a plurality of screws cooperatively engaging said clamping and mounting plates in fixed engagement with respect to one another.

6. The mounting bracket defined by claim 4 wherein said means for releasably securing said support arm within said slot comprises an opening in said clamping plate for threaded reception of an adjustable screw therethrough for with said support arm.

7. An archery bow mounting bracket assembly comprising:

a rectilinear support arm;

a mounting plate, comprising an open channel formed by two opposing side walls extending from a mounting base;

a clamping plate comprising an open channel formed by two opposing side members extending from a top plate, each of said side members being configured to mate between the side walls of said mounting plate; and means for securing the clamping plate to said mounting plate;

said side members and said mounting base and said top plate forming a rectilinear slot adapted to (i) slidably engage said support arm therein and (ii) secure said support arm within said slot when said clamping plate is secured to said mounting plate;

said means for securing said clamping plate to said mounting plate providing an infinitely adjustable support for said support arm.

8. The mounting bracket defined by claim 7 wherein said means for securing said clamping plate to said mounting plate comprises a plurality of screws cooperatively engaging said clamping and mounting plates in a fixed relationship with respect to each other.

9. The mounting bracket defined by claim 7 wherein said top plate has an opening therein for visually determining the transverse position of said support arm in said slot.

10. An archery bow mounting bracket assembly comprising:

a support arm;

a mounting plate comprising an open channel formed by two opposing side walls extending from a mounting base;

a clamping plate comprising an open channel formed by two opposing side members extending from a top plate, each of said side members being matable between the side walls of said mounting plate;

means for securing the clamping plate to said mounting plate, said side members and said mounting base and said top plate forming a slot adapted to slidably engage said support arm therein when said clamping plate is secured to said mounting plate, and provides a compressive action on said support arm; and means for releasably securing said support arm within said slot.

11. The mounting bracket defined by claim 10 wherein said means for securing said clamping plate to said mounting plate comprises a plurality of screws cooperatively engaging said clamping and mounting plates in fixed engagement with respect to one another.

12. The bracket assembly defined by claim 10 wherein said means for securing said support arm within said slot comprises an opening for the threaded reception of an adjustment screw in said support arm and clamping plate for cooperatively engaging and securing said clamping plate with said support arm.

13. The bracket assembly defined by 12 wherein said support arm comprises a plurality of threaded openings longitudinally spaced apart from one another, for the transverse adjustment of said support arm within said slot.

14. A bracket for supporting an elongate arm comprising:

a mounting base;

a mounting plate comprising an open channel formed by two opposing side walls extending from said mounting base;

a top plate having two opposing side members and being engagable with said mounting plate; and a clamping plate comprising an open channel formed in said two opposing side members extending from said top plate, each of said opposing side members being matable between said opposing side walls of said mounting plate;

said side members and said mounting base and said top plate forming a slot for receiving and supporting said elongate arm;

said clamping plate being secured to said mounting base by fasteners so that said elongate arm is infinitely adjustable.

* * * * *